US006565673B1

(12) United States Patent
Gong et al.

(10) Patent No.: US 6,565,673 B1
(45) Date of Patent: May 20, 2003

(54) SM(CO, FE, CU, ZR, C) COMPOSITIONS AND METHODS OF PRODUCING SAME

(75) Inventors: Wei Gong, Dayton, NJ (US); Bao-Min Ma, Apex, NC (US)

(73) Assignee: Santoku Corporation, Hyogo (JP)

( * ) Notice: Subject to any disclaimer, the term of this patent is extended or adjusted under 35 U.S.C. 154(b) by 0 days.

(21) Appl. No.: 09/830,474

(22) PCT Filed: Oct. 25, 1999

(86) PCT No.: PCT/US99/24989

§ 371 (c)(1),
(2), (4) Date: Jun. 15, 2001

(87) PCT Pub. No.: WO00/26926

PCT Pub. Date: May 11, 2000

Related U.S. Application Data

(60) Provisional application No. 60/106,360, filed on Oct. 30, 1998.

(51) Int. Cl.[7] ..... H01F 1/04

(52) U.S. Cl. ..... 148/303; 148/101; 148/104; 252/62.54

(58) Field of Search ..... 148/303, 101, 148/104; 252/62.54, 62.55

(56) References Cited

U.S. PATENT DOCUMENTS 4,536,233 A 8/1985 Okonogi 5,716,462 A 2/1998 Sakurada

FOREIGN PATENT DOCUMENTS

| | | |
|---|---|---|
| EP | 0156482 | 10/1985 |
| EP | 156482 | 10/1985 |
| JP | 5823406 | 2/1983 |
| JP | 5927756 | 2/1984 |
| JP | 59027756 | 2/1984 |
| JP | 6350441 | 3/1988 |
| JP | 63050441 | 3/1988 |
| JP | 551687 | 3/1993 |
| JP | 5051687 | 3/1993 |
| JP | 6322465 | 11/1994 |
| JP | 6322466 | 11/1994 |

OTHER PUBLICATIONS

Machine Translation of Japanese Patent Document No. 6–322466, Jun. 11, 1994.*

* cited by examiner

*Primary Examiner*—John Sheehan
(74) *Attorney, Agent, or Firm*—Stevens, Davis, Miller & Mosher, LLP

(57) ABSTRACT

Carbon addition to the rapidly solidified, preferably melt spun, alloy system of Sm(Co, Fe, Cu, Zr) provides for good isotropic magnetic properties. Importantly, these alloys are nanocomposite in nature and comprise the $SmCoC_2$ phase. Thermal processing of these materials can achieve good magnetic properties at lower temperatures and/or shorter processing times than conventional Sm(Co, Fe, Cu, Zr) powders for bonded magnet application.

15 Claims, 3 Drawing Sheets

| H.T. (°C) | 0 | 700 | 760 |
|---|---|---|---|
| Br (kG) | 6.2 | 7.6 | 7.5 |
| Hci (kOe) | 3.0 | 3.8 | 6.9 |
| Hcb (kOe) | 1.7 | 3.0 | 3.9 |
| (BH)max | 3.0 | 6.0 | 7.2 |

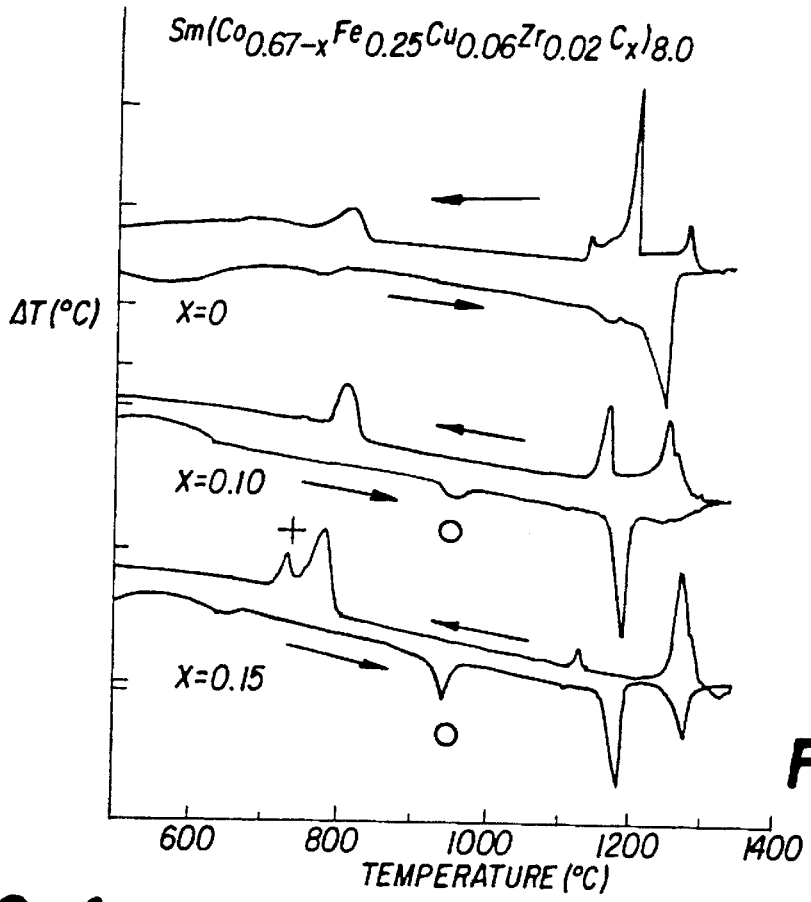
FIG. 3
FIG. 4
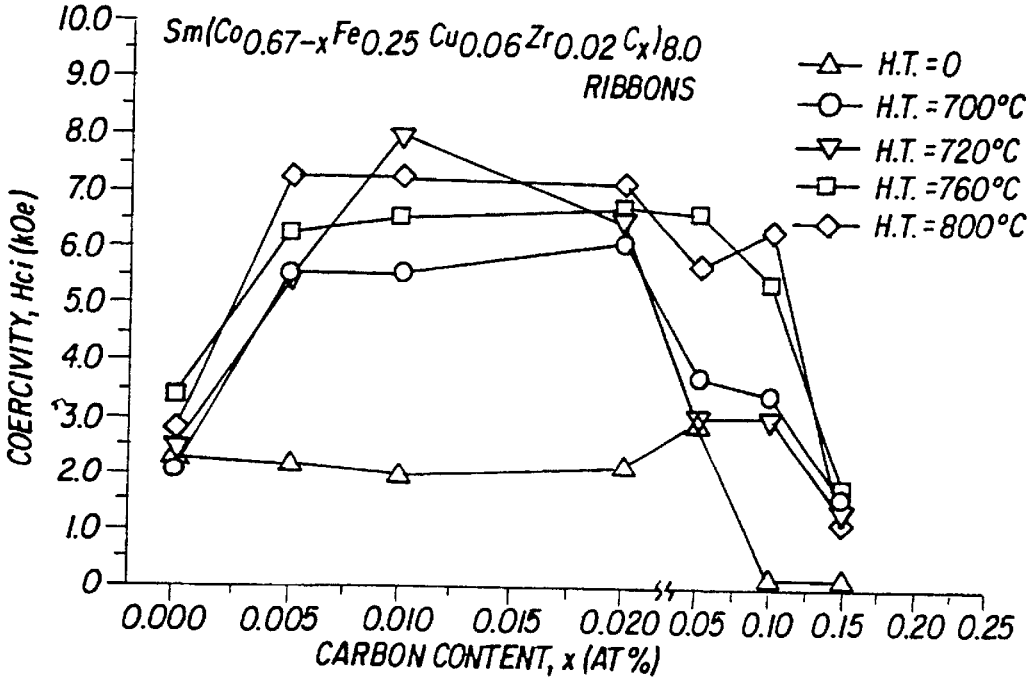

SM(CO, FE, CU, ZR, C) COMPOSITIONS AND METHODS OF PRODUCING SAME

This application claims the benefit of Provisional application Ser. No. 60/106,360, filed Oct. 30, 1998.

FIELD OF THE INVENTION

The present invention relates to magnetic materials, and more particularly relates to magnetic nanocomposite materials including samarium, cobalt, iron, copper, zirconium and carbon which have favorable magnetic properties and are suitable for making bonded magnets.

BACKGROUND INFORMATION

The $Sm(Co,Fe,Cu,Zr)_z$ sintered magnets exhibit outstanding thermal stability and high energy products at elevated temperatures due to their high Curie temperature and spontaneous magnetization. See K. J. Strnat, Proceeding of IEEE, Vol. 78 No. 6 (1990) pp. 923; and A. E. Ray and S. Liu, Journal of Materials Engineering and Performance, Vol. 2 (1992) pp. 183. However, sintered magnets are very hard and brittle, which makes final finishing very costly and may reduce the production yield rate significantly. The near net-shape production enables $Sm(Co,Fe,Cu,Zr)_z$ bonded magnets to be used for many sophisticated applications. In our previous work, we focused on the magnetic properties and developed $Sm(Co,Fe,Cu,Zr)_z$ powders for bonded magnet applications using conventionally cast alloys. See W. Gong, B. M. Ma and C. O. Bounds, J. Appl. Phys. Vol. 81 (1997) pp. 5640; W. Gong, B. M. Ma and C. O. Bounds, J. Appl. Phys. Vol. 83 (1998) pp. 6709; and W. Gong, B. M. Ma and C. O. Bounds, J. Appl. Phys. Vol. 83 (1998) pp. 6712. Our studies ranged from the effects of phase transformation, solid solution and aging heat-treatments, the particle size and distribution, and the consolidating pressure on the magnetic properties of bonded magnets.

Carbon is a common impurity found in the conventional cast $Sm(Co,Fe,Cu,Zr)_z$ alloys. It forms carbides and exhibits a negative impact on the intrinsic coercivity, $H_{ci}$, and maximum energy product, $(BH)_{max}$. Recently, C additions have been found to change the lattice parameters and, consequently, the magnetic anisotropy of many $Sm_2Fe_{17}$-based compounds prepared by casting. See B. G. Shen, L. S. Kong, F. W. Fang and L. Cao, J. Appl. Phys. Vol. 75 (1994) pp. 6253. Moreover, the melt spinning technique has been applied to this alloy system and has shown many interesting results. See Z. Chen and G. C. Hadjipanayis, J. Magn. Magn. Mate. Vol. 171 (1997) pp. 261. It is of interest to incorporate carbon into the conventional $Sm(Co,Fe,Cu,Zr)_z$ alloys system and to compare its impact on the structural and magnetic properties of materials prepared by different synthesizing methods.

It is the object of the present invention to provide compositions nanocomposite in nature.

It is the further object of the present invention to obtain isotropic magnetic properties.

It is an object of the present invention to obtain compositions comprising, preferably predominately, the $SmCoC_2$ phase.

Another object of the present invention is to provide compositions which require short thermal processing time and or low processing temperature to fully develop favorable magnetic properties.

These and other objects of the present invention will become more apparent from the following description and examples.

SUMMARY OF THE INVENTION

The magnetic nanocomposite compositions of the present invention include samarium (Sm) and cobalt (Co), copper (Cu) and iron (Fe), zirconium (Zr) and carbon (C). Preferably, compositions having a predominately $SmCoC_2$ phase. These compositions provide powder-bonded type magnets with favorable magnetic properties. The compositions are preferably rapidly solidified by conventional methods, most preferably by melt spinning, followed by thermally treating the material to form crystalline magnetic phases.

BRIEF DESCRIPTION OF THE DRAWINGS

FIG. 3 is a series of DTA scans on $Sm(Co_{0.67-x}Fe_{0.25}Cu_{0.06}Zr_{0.02}C_x)_{8.0}$ samples showing the endothermic (•)and exothermic(+) peaks of the $SmCoC_2$ phase.

FIG. 4 is a plot of coercivity, namely the variation of the $H_{ci}$ of $Sm(Co_{0.67-x}Fe_{0.25}Cu_{0.06}Zr_{0.02}C_x)_{8.0}$ ribbons as a function of the carbon content, x, after a heat-treatment temperature ranged from 700 to 800° C. for 5 minutes.

DETAILED DESCRIPTION OF THE INVENTION

Figure 2:
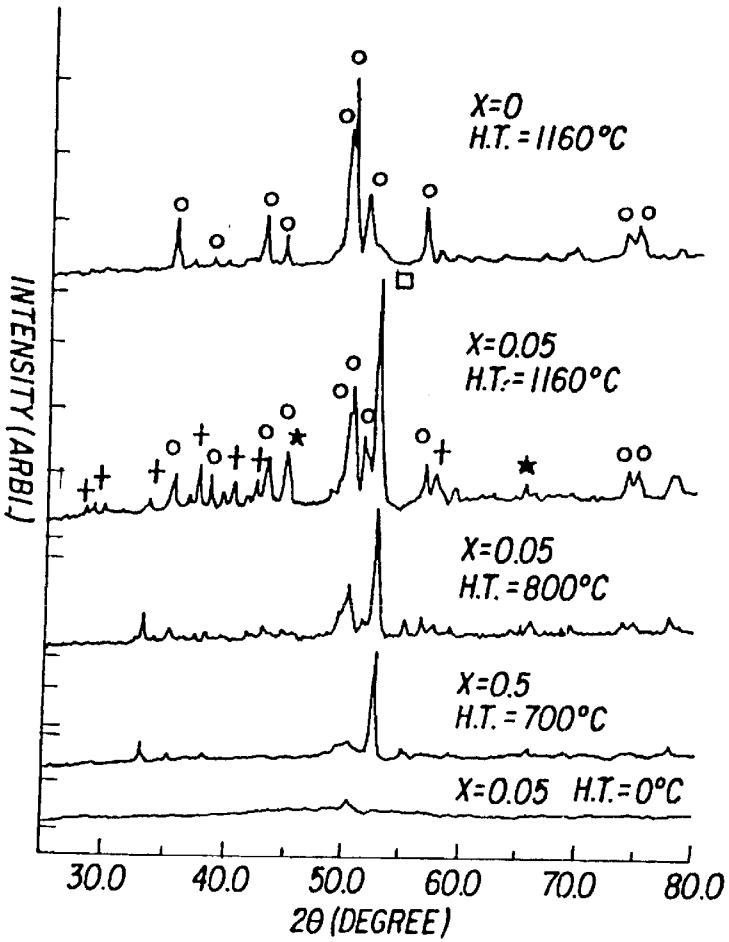
FIG. 2 is a series of X-ray powder diffraction patterns of $Sm(Co_{0.67-x}Fe_{0.25}Cu_{0.06}Zr_{0.02}C_x)_{8.0}$ ribbons where x=0 or 0.05 after various heat treatments. Diffraction peaks marked with (•), (+) and (*) are the $TH_2Zn_{17}$, $SmCoC_2$ and ZrC structure, respectively.

Compositions of the present invention are of the formula:

$$Sm(Co_{1-u-v-w-x}Fe_uCu_vZr_wC_x)_z:$$

wherein x, u, v, w, and (1-u-v-w) are generally in the range shown by TABLE A.

TABLE A

| | C x | Fe u | Cu v | Zr w | Co 1–u–v–w | z |
|---|---|---|---|---|---|---|
| Broadest Range | 0.001–0.25 | 0.01–0.4 | 0.01–0.20 | 0.001–0.20 | balance | 6.0–9.0 |
| Preferable | 0.005–0.20 | 0.10–0.35 | 0.03–0.08 | 0.01–0.04 | balance | 6.5–8.5 |
| Most Preferable | 0.01–0.12 | 0.2–0.3 | 0.05–0.07 | 0.02–0.03 | balance | 7.0–8.5 |

Zirconium may also be utilized in combination with titanium, hafnium, tantalum, niobium, and vanadium. Further, these elements, alone or in combination, may be substituted for Zirconium.

The magnetic materials of the present invention are preferably produced by a rapid solidification and thermal treatment process. Rapid solidification is achieved by quickly cooling the compositions from the molten state by known techniques such as melt spinning, jet casting, melt extraction, atomization and splat cooling. Preferred for use herein is melt spinning. After rapid solidification, the material is thermally treated.

Processing temperatures and duration ranges for thermal treatment are from about 400 to about 1200° C. for 0 to about 24 hours, preferably from about 500 to about 1150° C. for from about 1 minute to about 1 hour, and most preferably from about 700 to about 800° C. for from about 1 minute to about 10 minutes.

For bonded magnets prepared with the compositions of the present invention, operational ranges are generally from about 70 to about 500° C., preferably from about 40 to about 400° C., and most preferably from about 25 to about 300° C. Conventional methods for preparing bonded magnets can be utilized and generally comprise the steps of providing a composition of the present invention in powder form, mixing the powder with a binder and curing.

The following examples illustrate various aspects of the present invention and are not intended to limit the scope thereof.

Experimental

In this work, Applicants report the effects of carbon-addition on the magnetic and structural properties of $Sm(Co_{0.67-x}Fe_{0.25}Cu_{0.06}Zr_{0.02}C_x)_{8.0}$, where x=0 to 0.15. Emphasis is foucused on the comparison of the characteristics of materials prepared by the conventional casting and melt spinning.

The effects of C additions on the phase transformation and magnetic properties of $Sm(Co_{0.67-x}Fe_{0.25}Cu_{0.06}Zr_{0.02}C_x)_{8.0}$, where x ranged from 0 to 0.15, melt spun ribbons and and cast alloys have been studied by x-ray diffraction (XRD), differential thermal analysis (DTA), and vibrating sample magnetometer (VSM). In addition to the $Th_2Zn_{17}$ structure, two additional compounds, namely, the ZrC and $SmCoC_2$, were detected by XRD after a thermal treatment over about 700 to about 1160° C. The DTA scans indicated exothermic and endothermic peaks of the $SmCoC_2$ phase occur at about 740 and 950° C., respectively. The amount of $SmCoC_2$ is found to increase with increasing nominal C content and plays a critical role to the formation of amorphous precursor alloys. The as-spun ribbons were highly crystalline at x=0 and became mostly amorphous at x=0.10. An intrinsic coercivity, $H_{ci}$, of 3.0 kOe was obtained for the as-spun ribbons with x=0.05. After an optimum heat-treatment, the $H_{ci}$ of the ribbons with x=0.01 was increased to 8 kOe. Cast alloys of identical chemical compositions were also solution treated and precipitation hardened. At x=0 for the cast alloy, a $B_r$ of 10.8 kG, $H_{ci}$ of 24 kOe, $H_c$ of 9.8 kOe and $(BH)_{max}$ of 27 MGOe, were obtained after an optimum heat-treatment. Unlike melt spun materials, the hard magnetic properties of the conventionally cast alloys were found to decrease with increasing C-content and governed by a different magnetization reversal mechanism.

The $Sm(Co_{0.67-x}Fe_{0.25}Cu_{0.06}Zr_{0.02}C_x)_{8.0}$ master alloys were prepared by both the conventional vacuum induction melting and arc-melting. The melt-spun ribbons were made of master alloys by melt-spinning using a quartz tube with an orifice diameter of about 0.7 mm and a wheel speed in excess of 45 m/s. These ribbons were then sealed in a quartz tube under vacuum of $10^{-5}$ Torr and isothermally treated at temperatures ranging from about 700 up to 800° C. for 5 minutes. The master alloys were also solution treated at temperatures of about 1100–1200° C. for 12 hours, precipitated hardened at temperatures of about 800 to 900° C. for 8 hours, then slowly cooled at a rate of about 1° C./min to about 400° C. for 4 hours. A Perkin Elmer Differential Thermal Analyzer (DTA) was used to determine the phase transformation temperatures of samples. The crystal structure of the ribbons and master alloys were determined by a Siemens x-ray diffractometer, with a Co Kα radiation, in conjunction with a Hi-Star Area Detector. Magnetic properties of the ribbons and powdered alloys (−200 Mesh) were measured by a Vibrating Sample Magnetometer (VSM). For anisotropic powders, cylindrically shaped magnets were prepared by mixing powders with paraffin, aligned in a dc magnetic field with a maximum field of 30 kOe, melt then solidified. Magnets were pulse magnetized with a peak field of 100 kOe prior to any measurements. A theoretical specific density, ρ, of 8.4 g/cm$^3$ and demagnetization factors were used for calculating $4\pi M$, $B_r$ and $(BH)_{max}$, wherein M represents magnetization, $B_r$ represents magnetic remanence, and $(BH)_{max}$ represents maximum energy product.

Results and Discussion

Figure 1:
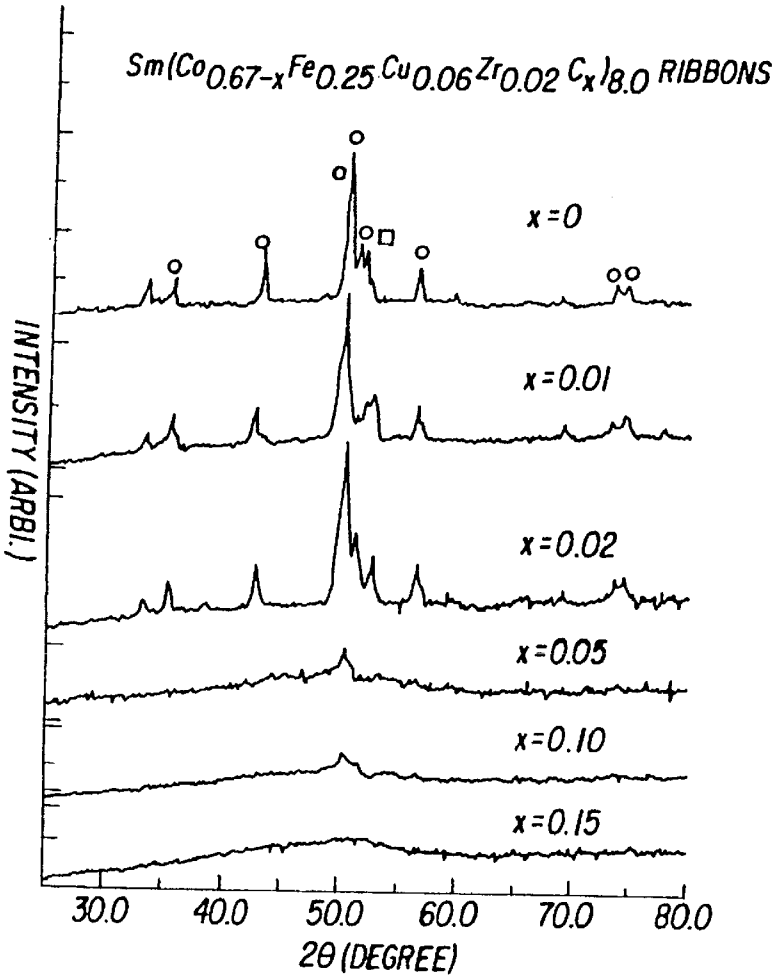
FIG. 1 is a series of X-ray powder diffraction patterns of $Sm(Co_{0.67-x}Fe_{0.25}Cu_{0.06}Zr_{0.02}C_x)_{8.0}$, where x=0 to 0.15, as-spun ribbons. Diffraction marked with (•) are the $TbCu_7$ structure.

Shown in FIG. 1 are the XRD patterns of the as-spun $Sm(Co_{0.67-x}Fe_{0.25}Cu_{0.06}Zr_{0.02}C_x)_{8.0}$ where x ranges from 0 to 0.15, ribbons as a function of the carbon content. At x=0, the ribbons were completely crystalline. These diffraction peaks can be indexed to the characteristic peaks of the hexagonal $TbCu_7$ mixed with a small amount of α-Fe. This result is similar to the structure change of melt spun $Sm_2(Co_{1-x}Mn_x)_{17}$ from the $Th_2Zn_{17}$ structure to the $TbCu_7$ when prepared above a critical wheel speed. See H. Saito, M. Takahashi and T. Wakiyama, J. Magn. Magn. Mate. Vol. 82 (1989) pp. 322. It was found that the characteristic peaks of $TbCu_7$ phase gradually diminish and become fully amorphous when the carbon content was increased from 0 to 0.15. This suggests that the C addition, when above a critical level, suppresses the formation of $TbCu_7$ and α-Fe.

Shown in FIG. 2 are the XRD patterns of $Sm(Co_{0.67-x}Fe_{0.25}Cu_{0.06}Zr_{0.02}C_x)_{8.0}$ ribbons in the as-spun and after various thermal treatments. Crystalline phase with a disordered $TbCu_7$ phase and α-Fe were observed when treated at temperatures from about 700 to 800° C. for 5 minutes. The $TbCu_7$ phase transformed to a rhombohedral $Th_2Zn_{17}$, when the samples were heated to about 1160° C. for 16 hours. When compared to the XDR characteristic peaks of $Sm(Co_{0.67}Fe_{0.25}Cu_{0.06}Zr_{0.02})_{8.0}$, i.e. at x=0, heat treated at the same temperature, two additional phases, namely of $SmCoC_2$ and ZrC, were also detected in the ribbons with a nominal compositional of $Sm(Co_{0.62}Fe_{0.25}Cu_{0.06}Zr_{0.02}C_{0.05})_{8.0}$, i.e. x=0.05.

Depending on the rare earth component, the $RCoC_2$, where R is the rare earth, forms two different crystallographic structures. It forms a monoclinic structure with light rare earths and orthorhombic structure with heavy rare earths. See W. Schafer, W. Kockelmann, G. Will, P. A. Kotsanidis, J. K. Yakinthos and J. Linhart, J. Magn. Magn. Mate. Vol. 132 (1994) pp. 243; and O. I. Bodak, E. P. Marusin and V. A. Bruskov, Sov. Phys. Crystallogr. 25 (1980) pp. 355. The $SmCoC_2$ phase also forms readily in the $SmCo_5$ magnets if the raw materials contain more than 0.03 wt % carbon or if magnets were contaminated by the carbon containing protection fluid during milling of the powder. See M. F. De Campos and F. J. G. Landgraf, Proc. 14th Inter. Work. Rare Earth Magnets and Appl., Vol. 1 (1996) pp. 432. The $RCoC_2$ is the only ternary phase detected in the Sm—Co—C isoplethic section at about 900° C. See H. H. Stadelmaier and N. C. Liu, Z. Metallkde. 76 (1985) pp. 585. The DTA scan of the $Sm(Co_{0.67-x}Fe_{0.25}Cu_{0.06}Zr_{0.02}C_x)_{8.0}$ alloys, shown in FIG. 3, reveals an endothermic peak during heating and an exothermic peak during cooling at about 950 and 740° C., respectively. The differential temperature, ΔT, of the $SmCoC_2$ peaks in $Sm(Co_{0.67-x}Fe_{0.25}Cu_{0.06}Zr_{0.02}C_x)_{8.0}$ alloys increases with increasing x. Alloys with a higher carbon content seem to form $SmCoC_2$ more readily. A higher amount of $SmCoC_2$ may be related to the ease of formation of amorphous precursor alloys.

The $Sm(Co_{0.67-x}Fe_{0.25}Cu_{0.06}Zr_{0.02}C_x)_{8.0}$ ribbons were heat-treated at about 700, 720, 760 and 800 for 5 minutes. Shown in FIG. 4 are the variation of $H_{ci}$ with the carbon content, x, at various thermal processing temperatures. At x=0, $H_{ci}$ values of 2.0 to 3.5 kOe were obtained after various thermal processing. Without carbon addition, the $H_{ci}$ appears to be insensitive to the thermal processing temperature due to the crystalline nature of the precursor alloy. At x=0.01, the $H_{ci}$ increases from 2 kOe in the as-spun state to 5.6 kOe at 700° C., peaks to approximately 8 kOe at 720° C., then decreases to 7.0 and 6.5 kOe when thermally processed at 760 and 800° C. Similar trends can be observed for x up to 0.05. At x=0.05, an $H_{ci}$ of 3.0 kOe was obtained on the as-spun ribbons and a $H_{ci}$ of 6.5 kOe was obtained after 760° C. treatment. Similarly, at x=0.10, an $H_{ci}$ of nearly 0 kOe was obtained in the as-spun state and agrees reasonably well with the amorphous nature of the as-spun materials. An $H_{ci}$ of 6.5 kOe was obtained after being thermally processed at 800° C. At high carbon content, namely x=0.15, limited $H_{ci}$ can be developed within the temperature range studied regardless of the amorphous nature of the precursor alloy ribbons. Based on these results, it suggests that the desired carbon content ranges from x=0.005 to 0.1 and the optimum thermal processing temperature seems to lie between about 720 to 760° C. This optimum processing temperature coincides considerably well with the exothermic peak of $SmCoC_2$ observed at about 740° C. as previously shown in FIG. 3. The carbon content and the thermal processing temperature are two important factors requiring control to develop the nanocomposite or the desired microstructure for the hard magnetic properties of the composition studied.

Figure 5:
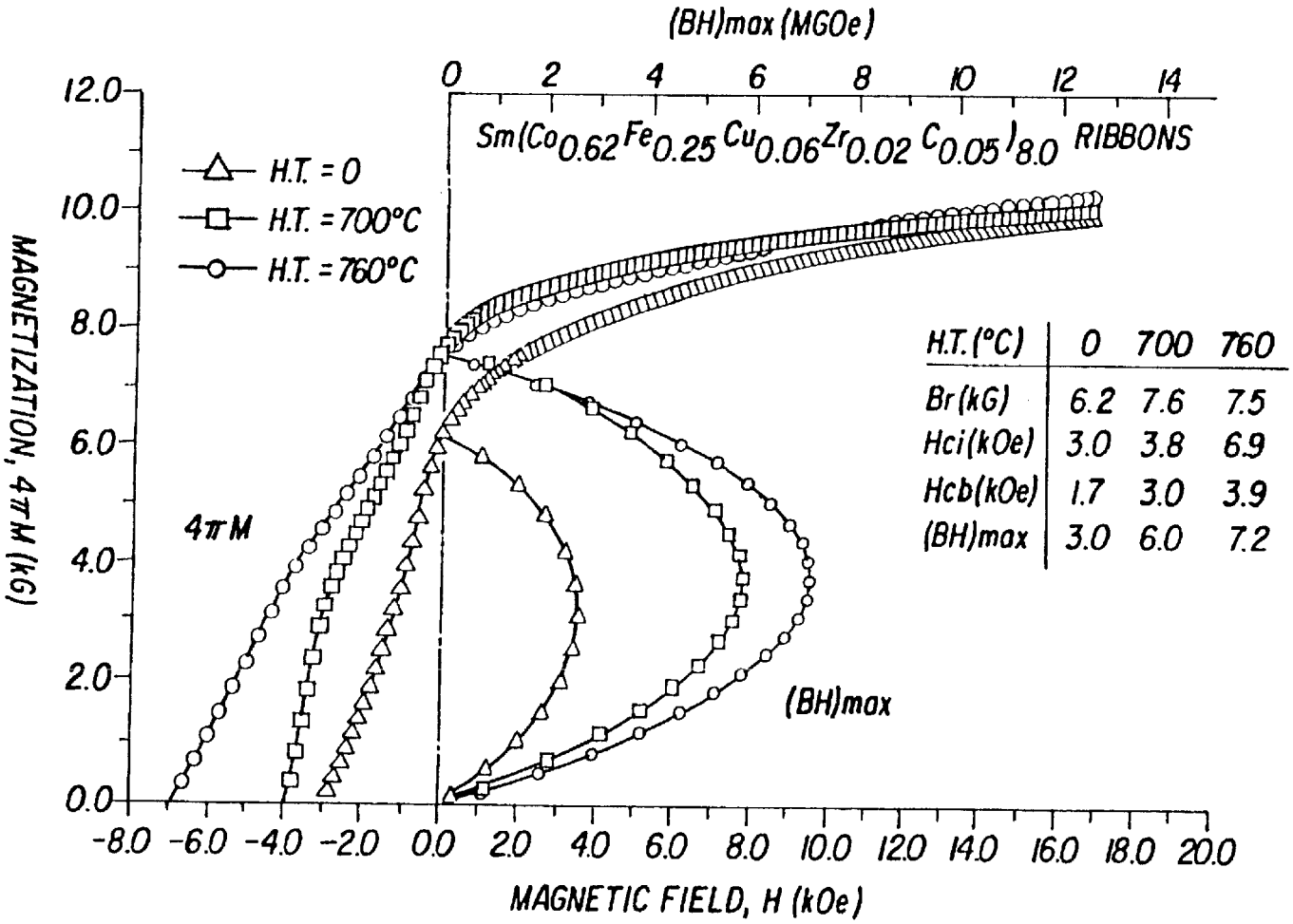
FIG. 5 is a series of magnetization curves and magnetic properties of $Sm(Co_{0.62}Fe_{0.25}Cu_{0.06}Zr_{0.02}C_{0.05})_{8.0}$ heat treated ribbons.

Shown in FIG. 5 are the magnetization curves, measured isotropically, of the $Sm(Co_{0.62}Fe_{0.25}Cu_{0.06}Zr_{0.02}C_{0.05})_{8.0}$ ribbons in the as-spun, and after thermal process 700 and 760° C. A $B_r$ of 6.2 kG, $H_{ci}$ of 3.0 kOe, $H_c$ of 1.7 kOe and $(BH)_{max}$ of 3.0 MGOe were obtained on the as-spun ribbons. A $B_r$ of 7.6 kG, $H_{ci}$ of 3.8 kOe, $H_c$ of 3.0 kOe and $(BH)_{max}$ of 6.0 MGOe were obtained after the ribbons were heat-treated at 700° C. A $B_r$ of 7.5 kG, $H_{ci}$ of 6.9 kOe, $H_c$ of 3.9 kOe and $(BH)_{max}$ of 7.2 MGOe were obtained after being processed at 760° C. A $(BH)_{max}$ of 7.2 MGOe, in conjunction with the high $T_c$, makes these materials attractive for the bonded magnet applications and deserve further investigation.

No permanent magnetic properties could be developed until a combined solid solution treatment at about 1160° C. and precipitation hardening at about 850° C. were adopted. It appears that the hard magnetic properties of $Sm(Co_{0.67-x}Fe_{0.25}Cu_{0.06}Zr_{0.02}C_x)_{8.0}$ follow the traditional mechanism: a cellular microstructure with finely precipitated platelets as pinning centers for magnetization reversal. Listed in Table I are the $B_r$, $H_{ci}$, $H_c$, and $(BH)_{max}$, measured anisotropically, of fully processed $Sm(Co_{0.67-x}Fe_{0.25}Cu_{0.06}Zr_{0.02}C_x)_{8.0}$. Unlike the melt spun materials, the $B_r$, $H_{ci}$, $H_c$ and $(BH)_{max}$ of $Sm(Co_{0.67-x}Fe_{0.25}Cu_{0.06}Zr_{0.02}C_x)_{8.0}$ diminish drastically with the increasing carbon content. It is hypothesized that alloy with high carbon content may form undesired phases and hinder the formation of cellular structure and the desired precipitated phases as pinning centers for the magnetization reversal.

Table I shows Magnetic properties of $Sm(Co_{0.67-x}Fe_{0.25}Cu_{0.06}Zr_{0.02}C_x)_{8.0}$ powdered master alloys after a solid solution treatment and precipitation hardening

TABLE I

| x (at %) | $B_r$ (kG) | $H_{ci}$ (kOe) | $H_{cb}$ (kOe) | $(BH)_{max}$ (MGOe) |
|---|---|---|---|---|
| 0 | 10.8 | 24 | 9.8 | 27 |
| 0.005 | 10.7 | 16 | 8.7 | 26 |
| 0.05 | 10.2 | 3.2 | 3.0 | 9 |
| 0.10 | 2.0 | 0.5 | 0.2 | ~0 |
| 0.15 | 2.0 | 0.5 | 0.1 | ~0 |

Conclusions

The effects of C additions on the phase transformation and magnetic properties of $Sm(Co_{0.67-x}Fe_{0.25}Cu_{0.06}Zr_{0.02}C_x)_{8.0}$, where x ranged from 0 to 0.15, melt spun ribbons and cast alloys have been studied. At low carbon concentration, the as-spun $Sm(Co_{0.67-x}Fe_{0.25}Cu_{0.06}Zr_{0.02}C_x)_{8.0}$ consists of the $TbCu_7$ structure with a minor amount of (α-Fe. In additional to the $Th_2Zn_{17}$ structure, two additional compounds, namely, the ZrC and $SmCoC_2$, were detected in the melt spun by XRD after a thermal treatment over 700 to 1160° C. The amount of $SmCoC_2$ is found to increase with increasing nominal C-content and plays a critical role in the formation of the amorphous precursor alloy. Thermally processed ribbons were found to exhibit isotropic magnetic properties. A $B_r$ of 7.5 kG, $H_{ci}$ of 6.9 kOe, $H_c$ of 3.9 kOe and $(BH)_{max}$ of 7.2 MGOe were obtained on an optimally processed $Sm(Co_{0.62}Fe_{0.25}Cu_{0.06}Zr_{0.02}C_{0.05})_{8.0}$. Unlike melt spun materials, the hard magnetic properties of the conventionally cast alloys were found to decrease with increasing C-content.

Whereas particular embodiments of this invention have been described above for purposes of illustration, it will be evident to those skilled in the art that numerous variations of the details of the present invention may be made without departing from the invention as defined in the appended claims.

What is claimed:

1. A nanocomposite magnetic material of the formula:

$Sm(Co_{1-u-v-w-x}Fe_uCu_vZr_wC_x)_z$, where x is from about 0.001 to about 0.25, u is from about 0.01 to about 0.4, v is from about 0.01 to about 0.20, w is from about 0.001 to about 0.20, and z is from about 6.0 to about 9.0, wherein the material comprises the $SmCoC_2$ phase.

2. The nanocomposite magnetic material of claim 1, wherein x is from about 0.005 to about 0.20, u is from about 0.10 to about 0.35, v is from about 0.03 to about 0.08, w is from about 0.01 to about 0.04, and z is from about 6.5 to about 8.5.

3. The nanocomposite magnetic material of claim 1, wherein x is from about 0.01 to about 0.12, u is from about 0.2 to about 0.3, v is from about 0.05 to about 0.07, w is from about 0.02 to about 0.03, and z is from about 7.0 to about 8.5.

4. The nanocomposite magnetic material of claim 1, wherein the material is in powder form.

5. The nanocomposite magnetic material of claim 4, wherein the powder has been produced by rapid solidification and thermal treatment.

6. The nanocomposite magnetic material of claim 5, wherein the powder is magnetically isotropic.

7. A method of making a nanocomposite magnetic material comprising:

a) providing a molten composition comprising:

$$Sm(Co_{1-u-v-w-x}Fe_uCu_vZr_wC_x)_z$$

where x is from about 0.001 to about 0.25,
u is from about 0.01 to about 0.4,
v is from about 0.01 to about 0.20,
w is from about 0.001 to about 0.20, and
z is from about 6.0 to about 9.0;

b) rapidly solidifying the molten composition to form a product at least comprising a partially amorphous phase; and c) thermally treating the product at a temperature ranging from about 400° C. to about 1200° C. for from about 1 minute to about 24 hours.

8. The method of claim 7, wherein the temperature ranges from about 500° C. to about 1150° C. for from about 1 minute to about 1 hour.

9. The method of claim 8, wherein the temperature ranges from about 700° C. to about 800° C. for from about 1 minute to about 10 minutes.

10. A bonded magnet comprising the nanocomposite material of claim 1.

11. A method of making a bonded magnet comprising:

a) providing the nanocomposite magnetic material of claim 1 in powdered form;

b) mixing the powdered nanocomposite magnetic material with a binder; and c) curing the binder to form the bonded magnet.

12. The nanocomposite magnetic material of claim 1, wherein x is from about 0:005 to about 0.10.

13. A nanocomposite magnetic material made according to the method of claim 7.

14. A nanocomposite magnetic material made according to the method of claim 8.

15. A nanocomposite magnetic material made according to the method of claim 9.

* * * * *